United States Patent [19]

Klein

[11] Patent Number: 4,757,898

[45] Date of Patent: Jul. 19, 1988

[54] TAMPER RESISTANT PACKAGING SYSTEM

[76] Inventor: Peter Klein, 71 Sterling Rd., Harrison, N.Y. 10528

[21] Appl. No.: 902,867

[22] Filed: Sep. 2, 1986

[51] Int. Cl.[4] ..... B65D 73/00

[52] U.S. Cl. ..... 206/459; 206/461; 206/807

[58] Field of Search ..... 206/807, 565, 459, 469, 206/471, 477, 461, 462, 467, 482, 465, 464; 108/55.1, 55.3

[56] References Cited

U.S. PATENT DOCUMENTS

| | | | |
|---|---|---|---|
| 2,043,070 | 6/1936 | Rutkowski | 206/482 |
| 2,598,492 | 5/1952 | Boes | 206/482 X |
| 3,099,475 | 7/1963 | Manizza | 206/175 X |
| 3,139,979 | 7/1964 | Russell | 206/459 X |
| 3,462,012 | 8/1969 | Fineman et al. | 206/459 |
| 3,472,363 | 10/1969 | Rustin, Jr. et al. | 108/55.1 |
| 3,523,608 | 8/1970 | Miller | 206/467 X |
| 3,542,193 | 11/1970 | Hewlett et al. | 206/459 |
| 3,942,640 | 3/1976 | Hellstrom | 206/469 |
| 4,426,004 | 1/1984 | Hoag | 206/807 X |
| 4,456,139 | 6/1984 | Kent | 206/459 X |
| 4,505,389 | 3/1985 | Whiteside | 206/807 X |
| 4,508,225 | 4/1985 | Ferrari | 206/465 X |
| 4,583,641 | 4/1986 | Gelzer | 206/485 X |
| 4,678,083 | 7/1987 | Anderson | 206/807 |

FOREIGN PATENT DOCUMENTS

| | | | |
|---|---|---|---|
| 644062 | 7/1962 | Canada | 206/602 |
| 2003819 | 3/1979 | United Kingdom | 206/469 |
| 1169894 | 7/1985 | U.S.S.R. | 206/523 |

*Primary Examiner*—Stephen Marcus
*Assistant Examiner*—Tracy G. Graveline
*Attorney, Agent, or Firm*—Mattern, Ware, Stoltz & Fressola

[57] ABSTRACT

By providing a product supporting base and frangible, removal indicating means securely retaining each product package on the support base, a unique tamper resistant, package assembly is attained, whereby the initial removal of each package from the base causes the frangible, removal indicating means to be irreversibly broken, bent or otherwise destroyed or deformed. In this way, no package can be removed for tampering and subsequently replaced on the supporting tray without the previous removal of the product being immediately apparent. In the preferred embodiments, the frangible removal indicating means comprise a plurality of finger members or flanges which embrace the package and securely retain the package to the support base. Upon removal of the package, the frangible finger members or flanges are irreversibly broken, bent, deformed or destroyed, thereby providing consumers with immediate notice that any product associated therewith has been previously removed and replaced.

13 Claims, 4 Drawing Sheets

FIG. 9
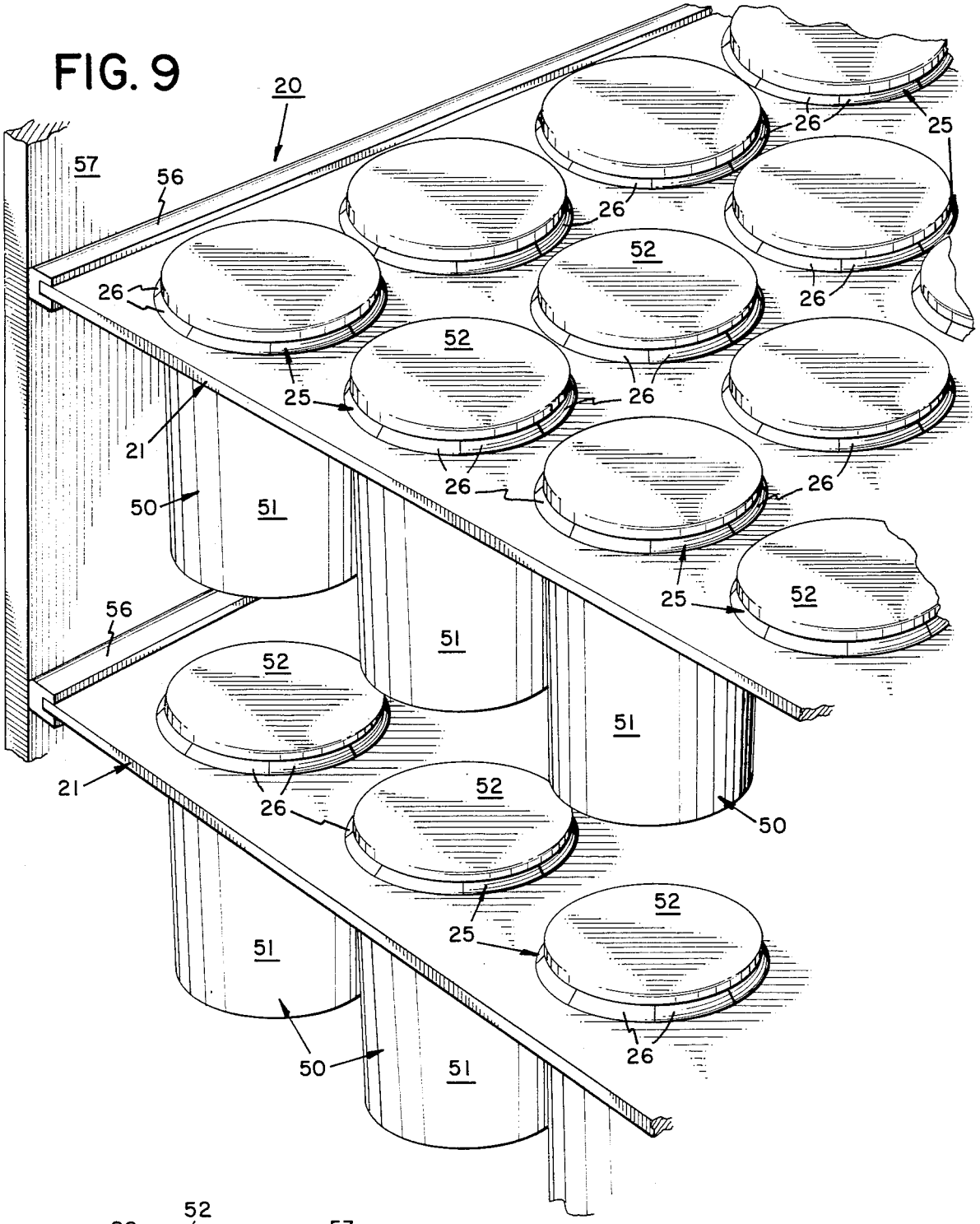
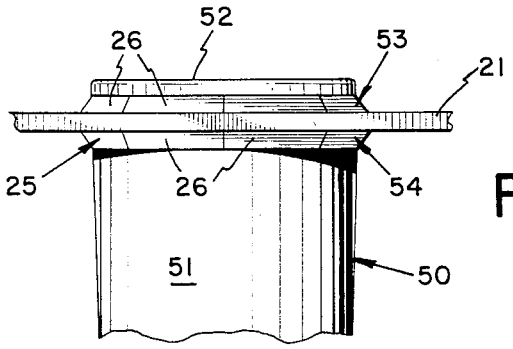
FIG. 10

TAMPER RESISTANT PACKAGING SYSTEM

TECHNICAL FIELD

This invention relates to tamper resistant packaging systems and more particularly to systems providing consumers and retailers with indicating means readily identifying any package which has been previously removed from the storage and display area.

BACKGROUND ART

During the last several years, the problems inherent in having food, beverage and non-prescription drug items removed from store shelves for the purpose of introducing poisons into the item, with the item being replaced on the store shelf for purchase by an unsuspecting customer, has received wide-spread media attention, as well as industry-wide recognition as a continuing problem. In an attempt to combat this problem, manufacturers of various food, beverage and non-prescription drug items have developed and employed tamper resistant packages for their products.

Unfortunately, in spite of these attempts, no tamper resistant package has yet proven impenetrable and, in fact, have been defeated by product tamperers, who have continued to plague consumers, distributors and manufacturers by introducing deleterious or life-threatening chemicals into food, beverage and non-prescription drug items which are then purchased by unsuspecting consumers.

Investigations have discovered that the product tampering has not occurred during the production, packaging, or delivery of the products to the retail consumer outlet. Instead, virtually all product tampering has occurred by a tamperer removing a product from the store shelf, bringing the product to his home or laboratory where the life-threatening chemical is substituted or added to the product, resealing the product to appear as though the product had never been opened, and returning the resealed, tainted product to the store shelf, where an unsuspecting consumer purchases this tainted product.

In spite of the industry-wide attempts to attain a packaging system which is completely tamper-resistant or which allows a consumer to immediately recognize a product or package which has been tampered with, no system has been developed which satisfies the needs of consumers, retailers and manufacturers or even properly addresses the wide potential problem which continues to exist. Although non-prescription drugs were the initial focal point of product tampering, many food and beverage products have also been tampered and along with non-prescription drugs remain as easy targets for tampering. In particular, food items packed in jars, canisters, tubes, bottles and other forms remain an easy target since the food items do not possess any, or sufficient, tamper resistant or tamper indicating packaging.

Therefore, it is a principal object of the present invention to provide a tamper resistant packaging system which is capable of providing consumers and retailers with an immediate indication of whether the product being purchased has been previously removed from its displayed position.

Another object of the present invention is to provide a tamper resistant packaging system having the characteristic features described above which can be employed for all types of packaging, regardless of their size, shape or container type.

Another object of the present invention is to provide a tamper resistant packaging system having the characteristic features described above which can be easily employed by the manufacturer without incurring any changes to their current or anticipated product or packaging.

Another object of the present invention is to provide a tamper resistant packaging system having the characteristic features described above which can be easily employed by the manufacturer without incurring a substantial expense, while providing a cost savings by eliminating current primary and/or secondary packaging.

A further object of the present invention is to provide a tamper resistant packaging system having the characteristic features described above which is capable of being employed by the retail distributor with ease and convenience.

Other and more specific objects will in part be obvious and will in part appear hereinafter.

SUMMARY OF THE INVENTION

The tamper resistant packaging system of the present invention overcomes all of the prior art objections and difficulties and establishes an efficient, reliable, and reasonably priced system in which the consumer can be assured that the package being purchased has never been removed from the display shelf prior to that particular consumer's purchase of the product. This goal is attained by providing a support base to which a plurality of individual product packages are securely retained, with each of said packages securely affixed to the support base by frangible or breakable means.

The frangible means are constructed to be irreversibly broken whenever the package is removed from the support base. Consequently, once removed, a package cannot be returned to the display area without the consumer knowing, since the irreversibly broken frangible means provide the consumer with immediate visual notice that the package has been previously removed therefrom.

In employing the present invention, the consumer, prior to removing the product from the display shelf, assures himself that the package being purchased is securely affixed to the support base with the frangible member intact. Once so assured, the consumer removes the desired package from the display, thereby causing the frangible means to be broken for the first time. Once broken, the frangible means are incapable of being reconstructed for subsequent use.

By employing the frangible, product interconnecting means of the present invention, no product can be removed from the display area of the store, and invaded for purposes of contamination prior to replacing the product on the store shelf. If any such would-be product tamperer were to attempt to defeat the system of the present invention, the tampered product could be replaced on the shelf of the store, but would have to be placed in a position in which the frangible elements were already broken. Consequently, a consumer would immediately know that this product had been previously removed from the display zone and replaced. Therefore, a consumer would immediately know that this is a product to be avoided and would, instead, select an alternate package in which the frangible, removal indicating means contained thereon are intact.

In accordance with the present invention, the removal indicating means incorporated on the support and display base may comprise a variety of alternate configurations. However, since each of the various embodiments of the present invention are equally effective, the selection of one particular embodiment or another is not dictated by its efficacy. Instead, the dominant reason for selecting one particular method would depend upon the particular product configuration or the manner in which the manufacturer wishes the product to be displayed.

In one embodiment, a plurality of frangible finger members are formed on the support and display base, with each of said finger members extending from the support and display base, peripherally surrounding each of the packages of the product retained thereon. If the package comprises a conventional box or box shape, each of these frangible finger members is securely affixed to the support base and extends upwardly therefrom, into secure abutting interconnected engagement with the container for each of the products.

With the plurality of finger members peripherally surrounding the container of each of the products, and with each of the finger members being securely embedded and interconnected with the container, no container can be removed from the support and display base without deforming or breaking all or most of the plurality of frangible finger members. In this way, any consumer seeing deformed or broken frangible finger members, will immediately know that the product positioned therein had been previously removed and replaced.

If the product package comprises a bottle or a bottle shape, the frangible finger members preferably extend from secured engagement with the support base into peripherally surrounding and holding engagement with the neck of the bottle. Removal of any bottle from the support base causes the securing frangible finger members to be broken, thereby informing the consumer that a product positioned therein had been previously removed.

In an alternate embodiment, a substantially continuous flange is employed instead of the plurality of finger members, with the flange extending from the support base and securely abuttingly engaging each product container. In addition, in this embodiment, the flange is preferably serrated or weakened in some manner, to allow the flange to be removed from the support base, along with the product. Consequently, the consumer can readily recognize any product which has been previously removed since the flange portion would be missing or would not be securely affixed to the support base.

If desired, the finger members could be constructed with a serrated zone, in order to cause the finger members to become completely separated from the support base whenever a product is removed from secure retention with the support base.

In a further alternate embodiment of the present invention, the tamper resistant packaging system comprises an upstanding flange or flange portions which are positioned peripherally about each product and incorporates at least one product retaining band extending from one side of said package to the opposed side thereof. In this way, no product package can be removed from the display without breaking the retaining band. Consequently, any consumer seeing a broken band and a product positioned therewith will have immediate notice that the product had been removed and replaced in the display zone.

In an alternate configuration, the upstanding flange can be serrated or otherwise weakened, thereby causing both the band and the flange to be removed along with the product. In this way, a consumer will be provided with further immediate visual indicia as to whether or not a product positioned in the display zone had been previously removed and subsequently replaced.

In a further alternate embodiment, the upstanding flange or flange portions can be eliminated by incorporating two product retaining bands which are positioned substantially perpendicularly to each other, thereby retaining all four opposed sides of a package. In this way, a package would be incapable of being removed from the product supporting base without breaking at least one of the bands. Consequently, a consumer would be assured of having means for visually identifying any product which had been removed and subsequently replaced.

In practicing the present invention, the frangible, removal indicating means may partially surround the product, provided the product cannot be removed without breaking some or all of the frangible means. Furthermore, the partially surrounding frangible, removal indicating means are positioned about the area or zone where the package is sealed, such as the end flaps or longitudinal seal along one side of the package.

In this way, the product contained in the package cannot be reached without breaking the frangible, removal indicating means. As a result, a product tamperer is incapable of shoplifting an entire tray, or tray portion, and tampering with the product at home, without causing the removal indicating means to be broken.

In addition, the support bases of the present invention are constructed for ease of use by the manufacturer and the retailer. With a plurality of product packages securely affixed to the support base, manufacturers can eliminate the need for heavy shipping cartons as well as carton inserts and dividers. Once assembled, a plurality of product containing support bases may be stacked and merely wrapped in a plastic film or a light-weight carton for shipment.

Furthermore, the support bases of the present invention represent a substantial benefit for the retailer, since handling of individual packages is eliminated. In using the present invention, the entire support base, with all of the products secured thereto, is positioned in the desired display zone, with the desired number of products being attained by simply stacking additional support bases on each other.

In an alternate embodiment, base retaining bracket means are affixed to the display zone, and each of the product containing support bases are retained in the display area by the bracket means. In this way, the products can be spaced apart for greater ease of removal, if necessary.

The invention accordingly comprises an article of manufacture possessing the features, properties and relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings in which:

FIG. 9 is a perspective view, partially broken away, depicting a still further alternate embodiment of the tamper resistant packaging system of the present invention, as well as an alternate display system therefor; and FIG. 10 is a front elevational view, partially broken away, of the tamper resistant packaging system of FIG. 9.

DETAILED DESCRIPTION

Figure 1:
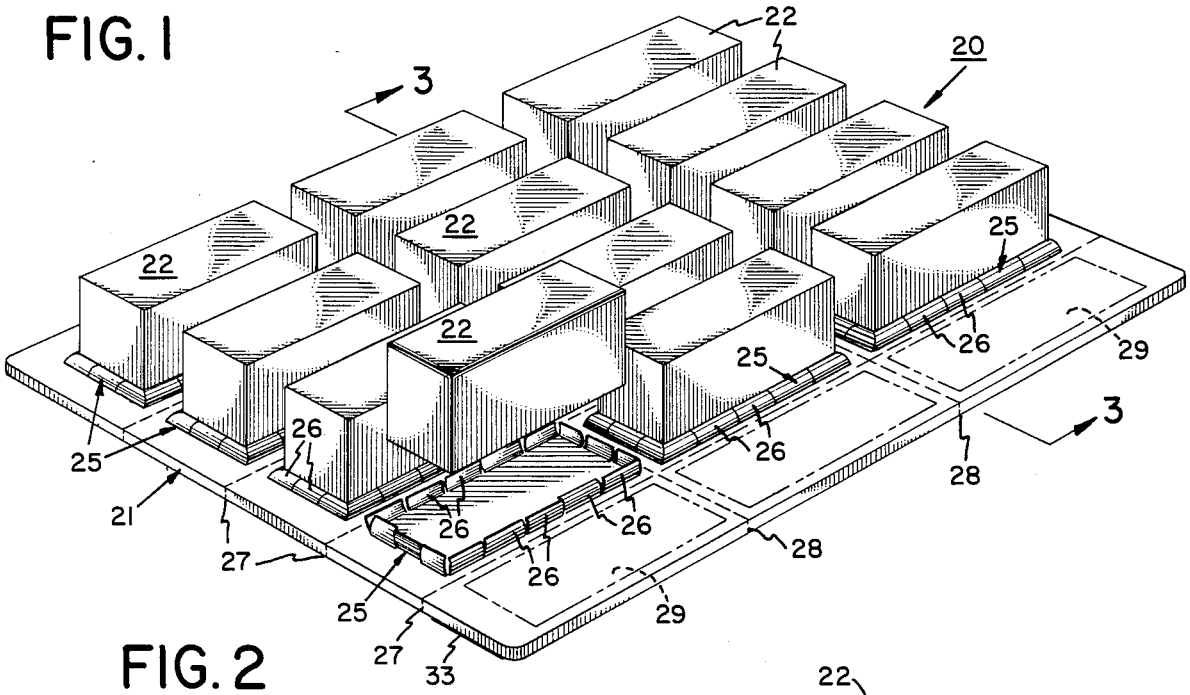
FIG. 1 is a perspective view of one embodiment of the tamper resistant packaging system of the present invention, with one package shown removed.

In FIG. 1, one embodiment of the tamper resistant packaging system 20 of the present invention is shown. In this embodiment, system 20 incorporates a supporting base 21 on which a plurality of independent product packages 22 are mounted. In addition, a plurality of independent removal indicating means 25 are mounted on support base 21, peripherally surrounding and securely abutting all sides of each package 22.

Figure 3:
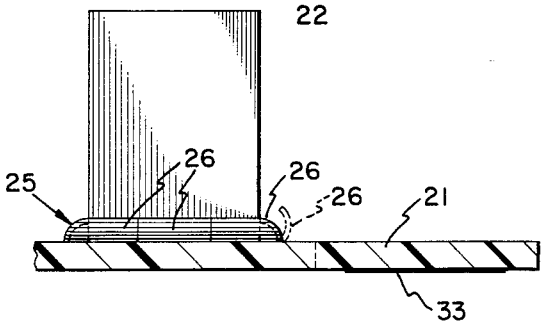
FIG. 3 is a cross sectional side elevational view, partially broken away, taken along line 3—3 of FIG. 1.

In this embodiment, removal indicating means 25 comprises a plurality of independent, irreversibly frangible or breakable finger members 26. As shown in FIG. 3, one end of each frangible finger member 26 is affixed to support base 21, while the opposed end securely abuttingly engages a portion of the side surface of package 22. In this way, package 22 cannot be removed from support base 21 without causing movement or flexing of finger members 26.

Since each finger member 26 is constructed from brittle, frangible material, any movement thereof causes finger member 26 to become broken, fractured, or irreversibly deformed out of engagement with package 22. Consequently, the removal of package 22 from its secure, affixed, mounted engagement with support base 21 immediately causes the simultaneous fracture breakage, or permanent deformation of a plurality of finger members 26.

With each of the finger members 26 forming removal indicating means 25 being composed of frangible material, any attempt to flex finger members 26 back into abutting engagement with package 22 merely causes further destruction of the particular finger members being so moved. Consequently, once a package 22 has been removed from its supported display position on support base 21, a plurality of frangible finger members 26 are irreversibly broken, providing any consumer, or distributor, or retailer with an immediate indication that any package positioned within the zone peripherally surrounded by a plurality of broken finger members 26 represents a package which has been previously removed and subsequently replaced into its present display zone. With this immediate knowledge, a consumer can avoid the purchase of that product for fear that that particular product had previously been handled by a product tamperer.

In the preferred construction of this embodiment, the plurality of finger members 26 extend peripherally about the entire outer surface of package 22, forming a substantially continuous protected zone thereabout. However, finger members 26 need not establish a continuous circumferential ring. If desired, open zones can be incorporated between adjacent finger members 26, provided sufficient finger members 26 are positioned on each side of package 22 to assure that package 22 cannot be removed from support base 21 without causing a fracture or breakage of a plurality of finger members 26. Furthermore, finger members 26 are also preferably positioned about the seal zone of the package, such as the end flaps or longitudinal seal formed along one side of the package. In this way, entry into the package is prevented without causing the frangible, removal indicating means to be broken.

In order to employ the present invention, a manufacturer of packages 22 would incorporate the tamper resistant packaging system of the present invention as part of its product as shipped. Consequently, as shown in FIG. 1, a convenient number of packages 22 would be securely affixed to each support base 21.

Figure 2:
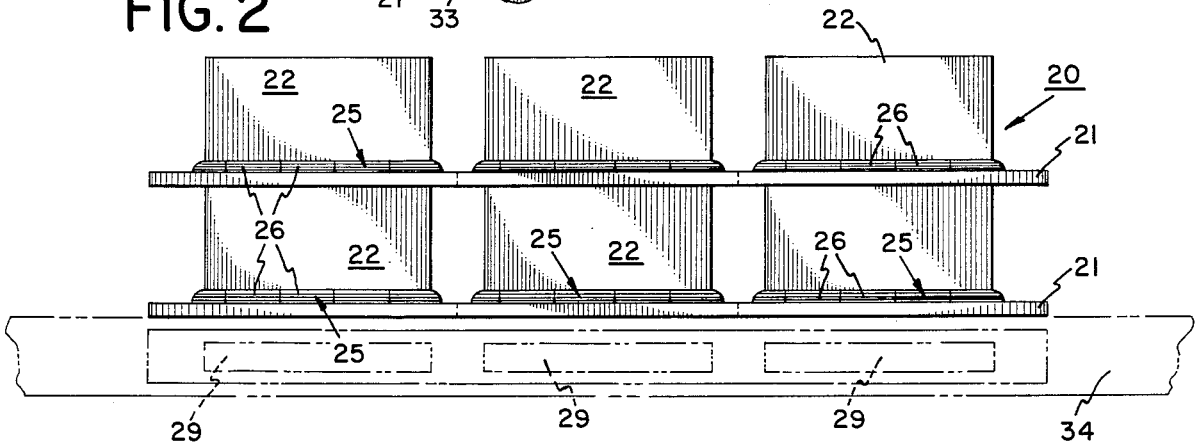
FIG. 2 is a front elevation view depicting the stackability of the tamper resistant packaging system of the present invention.

This arrangement is particularly advantageous for retailers, since handling and stacking each individual package is eliminated. Instead, once marked with the price, support base 21, with all of the packages secured thereto, is placed in the store display zone in one easy step. As shown in FIG. 2, a plurality of package supporting bases 21 can be easily stacked on top of each other, in order to achieve the desired quantity of product in any one particular display zone.

For further added convenience, tamper resistant packaging system 20 also incorporates elongated score or separation lines 27 which allows the retailer to easily remove sections of support base 21 after all of the packages 22 have been removed from that section. In this way, the packages secured to the rear of support base 21 can be easily moved forward for purchase.

Figure 4:
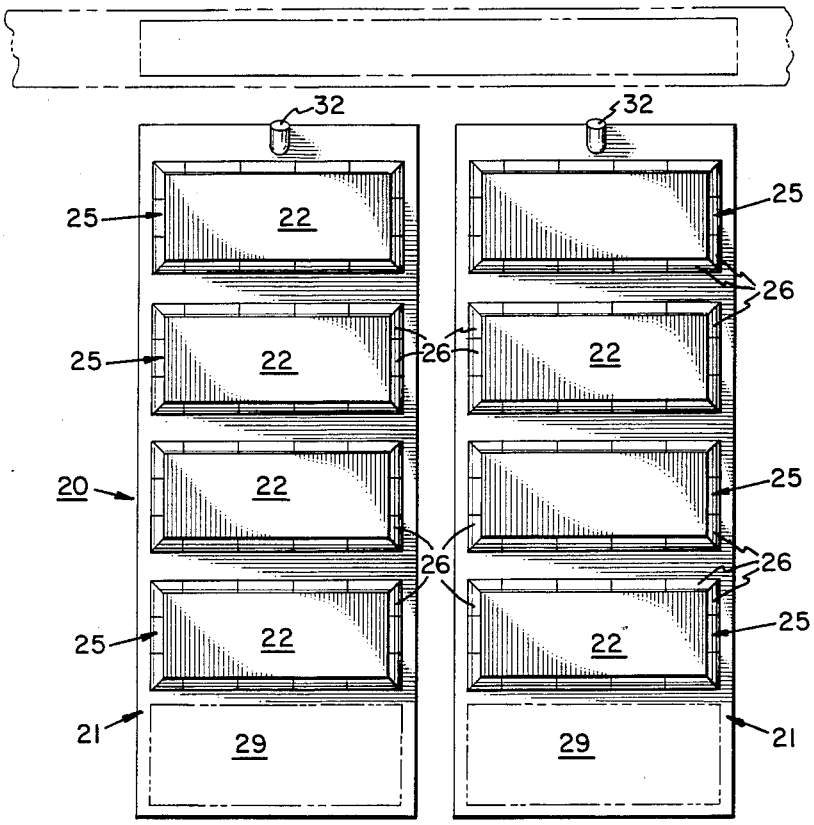
FIG. 4 is a front elevation view depicting the tamper resistant packaging system of the present invention as displayed in a conventional rack system.

In addition, support base 21 also incorporates elongated score lines or separation lines 28 extending the length of base 21, substantially perpendicular to score lines 27. In this way, support base 21 can easily be divided into three independent support base strips, with each of these independent support base strips being either stacked, in the general manner shown in FIG. 2, or if desired, placed on hooks 32 for display to the consumer, as shown in FIG. 4, using a hook receiving hole formed in base 21. By employing either of these options, the retailer is capable of employing the tamper resistant packaging system 20 of the present invention quickly and easily, without requiring independent, separate manual handling of each package 22. As a result, delivery of the packages to the consumer would become more expeditious and convenient for the retailer. Of course, the manufacturer determines and establishes the number of independent support base strips to be provided.

In its preferred embodiment, support base 21 incorporates a label display zone 29, as shown in FIGS. 1 and 4. Label display zone 29 preferably contains all of the information a consumer would desire about the product secured to base 21, such as product trademark and key label copy elements. By employing label display zone 29, consumers will not have to remove a package 22 from base 21 to read the information printed thereon, without desiring to purchase the item.

In addition, fastening means, such as double sided tape 33, may be affixed to the underside of base 21, along the area of label display zone 29, as shown in FIGS. 1 and 3. In this way, as packages 22 are purchased and empty sections of base 21 are removed along score lines 27, the section containing label display zone 29 can be easily affixed to the edge of base 21. As a result, the label information will always be available to the consumer. If desired, other fastening means such as clips, interlocking fabric, etc. may be employed. Alternatively, if desired, the product label information can be permanently displayed along the edge of the store shelf 34, as shown in FIG. 2, using label display zones 29.

Figure 5:
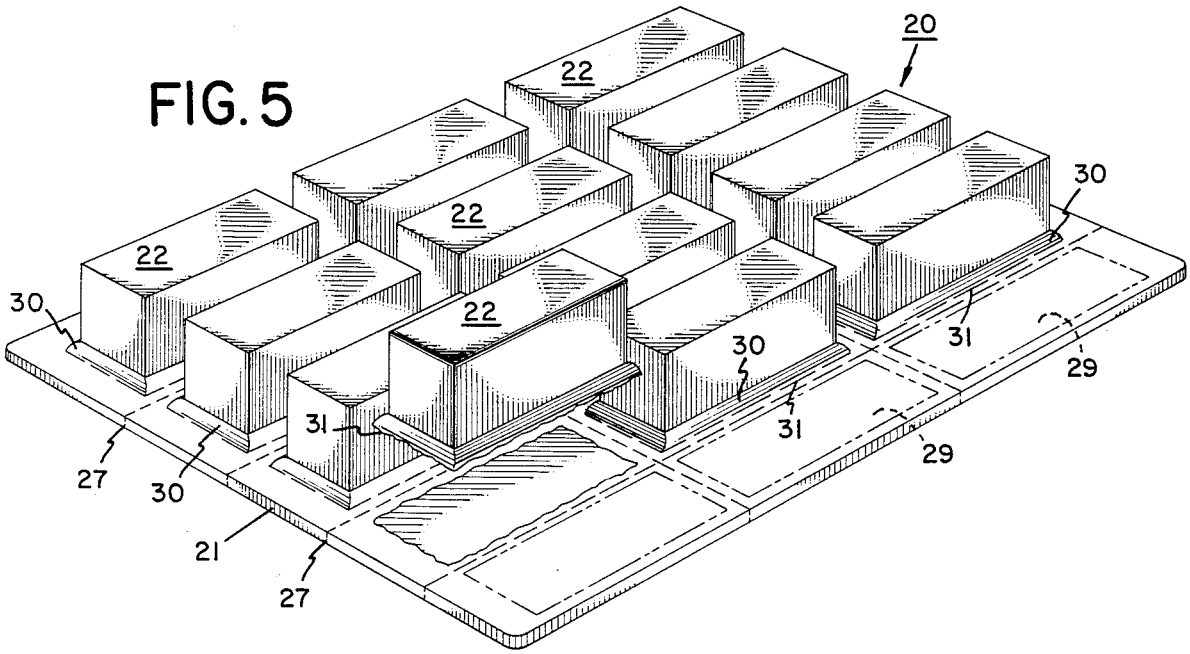
FIGS. 5–8 are perspective views depicting alternate embodiments of the tamper resistant packaging system of the present invention.

In FIG. 5, an alternate embodiment of tamper resistant packaging system 20 of this invention is shown. In this embodiment, removal indicating means 25 comprises a substantially continuous upstanding flange 30 which peripherally encircles package 22 as detailed above in reference to FIG. 1. Flange 30 is securely affixed at one end thereof to support base 21, while having its opposed end abuttingly engaged with a portion of package 22.

In the preferred construction of this embodiment, flange 30 incorporates a serrated zone 31 which extends along the entire length of flange 30 peripherally about the entire package 22. Whenever package 22 is to be removed by the consumer, the removal force exerted on package 22 by the consumer causes flange 30 to separate from base 21 along serrated zone 31, leaving flange 30 securely affixed to package 22. In this way, the consumer is immediately made aware that the package being purchased is an authentically manufactured product which has not been previously tampered with and replaced into the display zone by both the presence of the flange 30 securely affixed thereabout, coupled with the knowledge that the consumer physically caused the flange to be disconnected from its secured position on support base 21.

Consequently, the selection of a package which does not have a flange thereon, or which has a flange positioned thereon but is a flange which was previously broken, would provide the consumer with immediate notice that the package selected had been previously removed from support base 21 and replaced thereon. With this information, the consumer will know that this package should be returned and another package should be selected for purchase.

In a further alternate embodiment of the present invention, a peripherally surrounding serrated zone 31 is formed along finger members 26. In this way, the removal of the package 22 not only causes the permanent deformation or fracture of finger members 26, but also simultaneously causes most of the finger members 26 to become completely disconnected from support base 21, simultaneously with the removal of package 22 from its supportingly engaged position on base 21.

By employing this embodiment, a consumer can quickly and easily identify any previously removed package since finger members 26 would be virtually eliminated from support base 21 during the initial removal of the package. Consequently, the lack of presence of any finger member 26 peripherally surrounding and securely affixing package 22 to support base 21 would provide the consume with immediate notice that the package displayed thereon had been previously removed and subsequently replaced.

Figure 6:
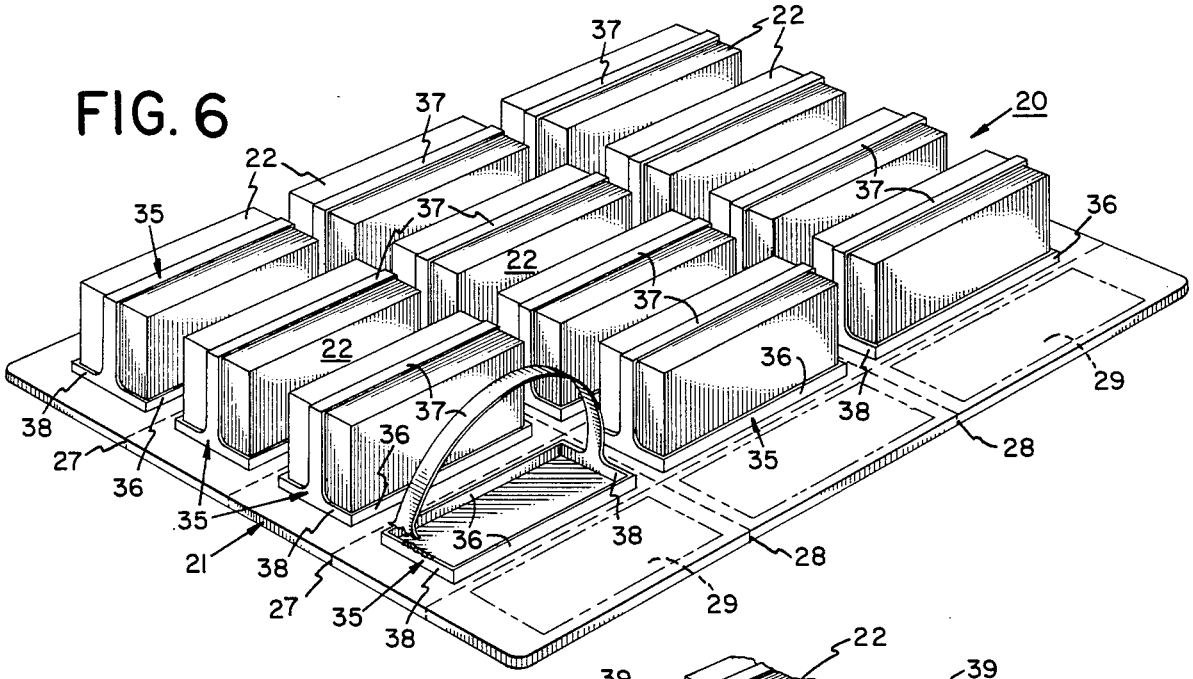

In FIG. 6, another alternate embodiment of tamper resistant packaging system 20 is shown. In this embodiment, tamper resistant packaging system 20 incorporates a product package supporting base 21 in combination with package removal indicating means 35.

Package removal indicating means 35 comprises a first pair of substantially continuous upstanding flanges 36 which extend along two opposed sides of package 22, and a second pair of substantially continuous upstanding flanges 38 which extend along the remaining two opposed sides of package 22. In addition, an elongated product retaining strap or band 37 is provided which overlies package 22 and securely holds package 22 to base 21. As shown in FIG. 6, retaining band 37 is securely affixed at its opposed ends to flanges 38. By combining upstanding flanges 36 and 38 with product retaining band 37, every package 22 is securely affixed to supporting base 21 and is incapable of being removed from support base 21 without breaking either band 37, flange 36 or flange 38.

In the preferred embodiment, the material employed for band 37 and flanges 36 and 38 is formulated to assure that once strap 37 or flanges 36 or 38 have been broken, repair of the broken area is not possible. In this way, whenever a package 22 is to be removed from support base 21, either band 37, flange 36 or flange 38 must be broken in order to free package 22 from its securely retained position on support base 21.

Once package 22 has been removed from support base 21, it is impossible for anyone to replace package 22 on support base 21 with the band 37 and flanges 36 and 38 returned to their original secured, package retaining configuration. Consequently, if any such package were to be replaced on support base 21, the consumer would immediately become aware that the package had been previously removed from support base 21 and returned to its present position.

In FIG. 6, the preferred embodiment for removal indicating means 35 is shown with the two pairs of upstanding flanges 36, and 38 positioned in secure, upstanding relationship with support bas 21 with both pairs of flanges 36 and 38 extending peripherally about substantially the entire package 22. However, removal indicating means 35 may be constructed in a variety of alternate configurations, without departing from the scope of this present invention. In one such alternate embodiment, flanges 38 can be completely eliminated, with package retaining band 37 being directly connected to and extending from support base 21. Furthermore, flanges 36 or flanges 38 need not be formed continuously, substantially along the entire sides of package 22. If desired, a plurality of spaced flange portions could be employed with equal efficacy.

In an alternate embodiment for removal indicating means 35 both pairs of flanges 36 and 38 may be constructed with a serrated zone extending along both pairs of flanges 36 and 38 in juxtaposed, spaced relationship with the interconnection of flanges 36 and 38 with support base 21. In this way, the removal force exerted by a consumer desiring to purchase package 22 would cause band 37 and flanges 36 and 38 to separate entirely from support base 21 along the serrated zone 39. This construction would be similar to the structure detailed above in reference to FIG. 5.

In a further alternate embodiment, a plurality of cavities may be formed in base 21, with the lower portion of a package 22 being inserted and securely retained in each cavity. Each package 22 is then securely affixed to base 21 by a frangible, product retaining band 37.

Clearly, in order to remove package 22 from base 21, band 37 must be broken.

In another embodiment, band 37 may extend between flanges 36, as opposed to flanges 38. Furthermore, a plurality of bands may be used, either in parallel or perpendicular to each other. Clearly, band 37 as shown is merely for exemplary purposes, and the inherent flexibility that is attainable with the tamper resistant packaging system of this invention, as well as the manner in which these configurations can be altered in order to achieve any particular arrangement or desired appearance is evident from this disclosure.

Figure 7:
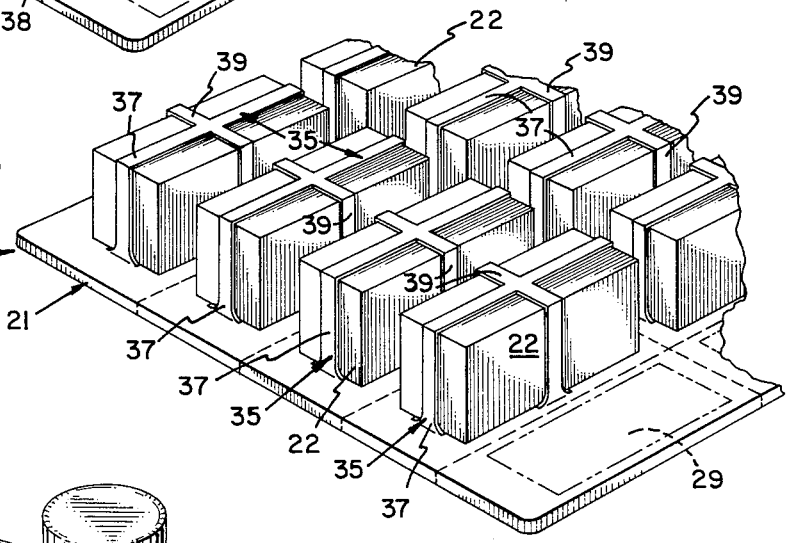

In FIG. 7, a further alternate embodiment of the present invention is shown wherein a second product retaining band 39 is employed along with band 37 to form removal indicating means 35. As shown therein, band 39 extends substantially perpendicularly to band 37, intersecting band 37 substantially midway along its length. In this configuration, both pairs of flanges 36 and 38 are completely eliminated, since only bands 37 and 39 are required to securely retainingly mount each package 22 to support base 21.

In order to securely retain package 22 in mounted engagement on support base 21, and provide an immediate, irreversible removal indication to the consumer, removal indicating means 35 must prevent the careful removal of package 22 from secure, mounted engagement on base 21 in a manner that would avoid some portion of the removal indicating means to be broken. Consequently, if a single band 37 or 39 were to be employed, one pair of flanges 36 or 38 must also be employed in order to prevent the possibility that package 22 might be slid from its retained position without breaking band 37 or 39.

However, when two, perpendicularly disposed bands 37 and 39 are employed, package 22 cannot be removed from secure mounted engagement therewith, without causing at least one of said bands to be broken. Consequently, the use of bands 37 and 39 in a mutually perpendicular arrangement allows both pairs of flanges 36 and 38 to be eliminated.

Although the previous discussion of the various alternate embodiments of tamper resistant packaging system 20 of this invention has been detailed with reference to rectangular boxes serving as the package being securely retained, the present invention is not so limited and is equally applicable to all packages regardless of their form, configuration or products contained therein (i.e., foods, beverages, non-prescription drugs, toiletries, etc.). In order to exemplify the universal applicability of the present invention, tamper resistant packaging system 20 of this invention is depicted in FIG. 8, securely retaining a plurality of bottles 42 in secure, mounted engagement on product supporting and retaining base 21.

In this embodiment, removal indicating means 25 comprises a plurality of frangible or breakable finger members 26, which peripherally surround product retaining bottle 42 about the neck portion thereof. As shown in FIG. 8, the preferred embodiment employs a plurality of side by side finger members 26, so that the entire neck portion of bottle 42 is peripherally surrounded and enveloped.

If desired, however, finger members 26 may be constructed with the finger members being spaced apart provided a sufficient number of finger members 26 are employed to securely retain bottle 42 in secure mounted engagement on support base 21 and prevent the removal of a bottle 42 from support base 21 without causing the frangible finger members 26 to be fractured, bent, or otherwise destroyed during the removal process.

Figure 8:
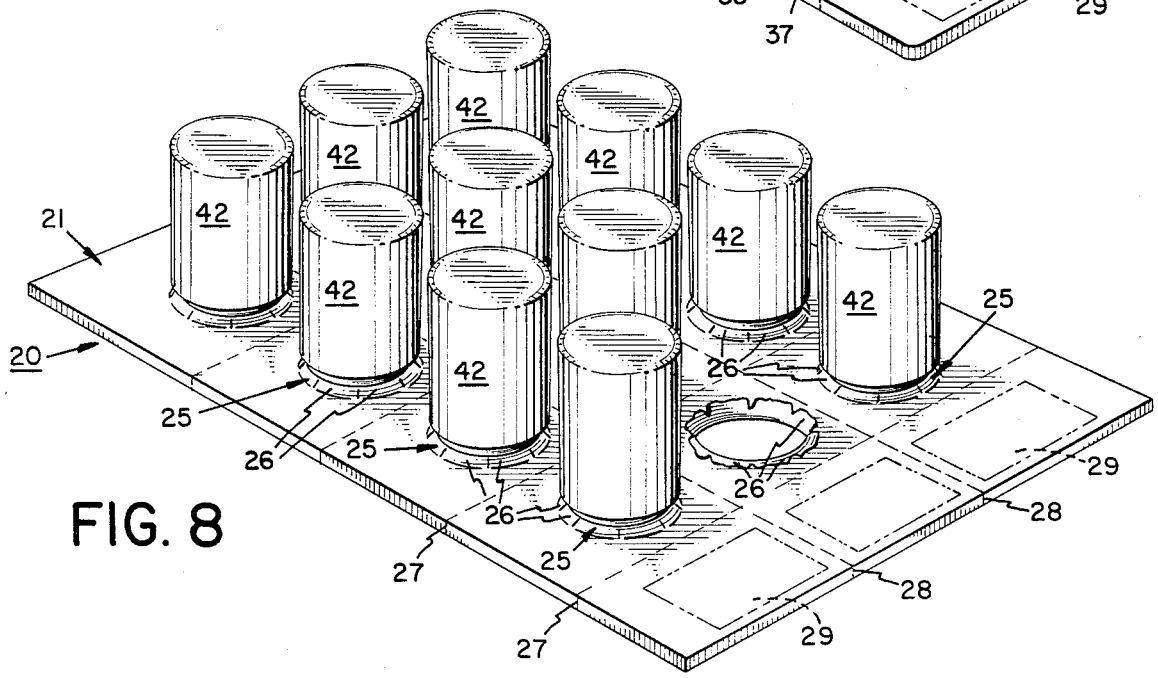

As shown in FIG. 8, when the preferred configuration for this embodiment is employed, the plurality of frangible finger members 26 are forced upwardly when bottle 42 is removed from supporting mounted engagement on base 21. The movement of bottle 42 causes the fragile, brittle, frangible finger members 26 to be bent, broken or permanently deformed.

In this way, no bottle 42 is capable of being removed from support base 21 without causing a plurality of frangible finger members 26 to be obviously and irretrievably broken or otherwise mutilated. Consequently, no bottle 42 can be removed from support base 21 and subsequently replaced on base 21 without this fact becoming immediately evident to a purchaser.

As discussed above, support base 21 also incorporates preformed score lines or separating lines 27 in order to allow the empty section of base 21 to be easily removed, so that the bottles in the rear can be moved forward for consumer convenience. In addition, score lines 28 are also employed to allow support base 21 to be easily converted into a support base containing a single row of bottles 42. As detailed above, each section of support base 21 incorporates a convenient wire or hook receiving hole to allow each section of base 21 to be easily mounted for display on a typical rack system.

Furthermore, each section of support base 21 also incorporates a label display zone 29 in which all of the necessary information concerning the product mounted on support base 21 is fully displayed, such as product trademark and key label copy elements. In this way, a consumer is capable of reading the label information without requiring or necessitating the purchaser to move bottle 42 or possibly remove bottle 42 in order to obtain the information directly from bottle 42, without desiring to purchase the product. Preferably, label zone securing means 33 would also be incorporated, to allow label display zone 29 to be quickly and easily secured to any section of support base 21.

In addition, in order to provide a consumer ease of product identification, as well as subsequent use of the product, each bottle 42 may comprise two substantially identical labels, which are affixed thereto so that the printing is 180° from each other. In this way, a consumer would easily be capable of reading the requisite information from bottle 42 while bottle 42 is in its secured retained position on support base 21, using one of the labels, while also being capable of easily reading any desired information from bottle 42 when bottle 42 is at home, by employing the second label with its print being positioned 180° from the first label. In this way, the information can be easily read when the bottle is stored in its typical fashion with the bottom of the bottle down.

In the preferred embodiment, as depicted in FIG. 8, removal indicating means 25 peripherally surrounds bottle 42 about the neck portion thereof, since the neck portion typically comprises the smallest diameter of a conventional bottle. This assures that each bottle 42 is securely affixed to support base 21 and cannot be removed from support base 21 without causing a plurality of the frangible finger portions 26 to become broken or deformed.

If desired, finger members 26 may be serrated, thereby causing the finger members to be broken free of support base 21 during the bottle removal process. Alternatively, a continuous, serrated flange may be employed, as a further alternate embodiment.

In FIGS. 9 and 10, a still further alternate embodiment of tamper resistant packaging system 20 of the present invention is shown. In this embodiment, tamper resistant packaging system 20 incorporates supporting base 21 and product removal indicating means 25. In this embodiment, product removal indicating means 25 securely retains and supportingly holds a conventional, substantially cylindrical, jar-type container 50. In typical fashion, container 50 comprises a deep, broad mouthed jar portion 51, which comprises glass or other suitable material, in combination with cover or lid portion 52, which is threadily engaged with one end of jar portion 51, sealing jar portion 51 thereby. Generally, lid 52 comprises a diameter slightly greater than the largest diameter of jar portion 51.

In this embodiment, removal indicating means 25 preferably comprises a plurality of frangible or irreversibly breakable finger members 26, which are arranged in two independent cooperating aligned rings 53 and 54, each of which peripherally surround and engage container 50, securing container 50 to supporting base 21. As best seen in FIG. 10, ring 52 of frangible or breakable finger member 26 peripherally surrounds and securely engages lid 52 of container 50, while ring 54 of frangible finger member 26 peripherally surrounds and securely engages jar portion 51 of container 50. In this embodiment, the major portion of container 50 extends below product supporting base 21, supportingly secured to base 21 by the engagement of container 50 with the removal indicating means 25.

By employing two juxtaposed, spaced, cooperating rings 53 and 54 of frangible finger members 26, both the lid portion 52 and the jar portion 51 of product container package 50 is securely affixed in supported mounted engagement to base 21, with the entire container 50 peripherally surrounded and enveloped thereby. In this preferred construction, each ring 53 and 54 both comprise a plurality of frangible finger member 26, with the finger members directly adjacent to each other, forming a substantially continuous, peripherally surrounding ring. However, if desired, open zones may be incorporated into rings 53 and 54, provided a sufficient number of frangible finger members 26 are employed to securely retain and support container 50, as well as provide the desired removal indication.

As detailed above, in reference to the other embodiments incorporating frangible finger members 26, this embodiment would operate in a substantially identical fashion with a plurality of frangible finger members 26 in both ring 53 and 54 being fractured, bent or otherwise deformed or destroyed during the removal of container 50 from support base 21. In this way, no container 50 can be removed, have deleterious material added to it and returned to base 21, without the consumer immediately knowing that the package had been previously removed.

Furthermore, in this embodiment, a potential tamperer could not even remove lid 52 while container 50 remains in supported engagement with base 21 for tampering with the product while in the store. Since both lid 52 and jar 51 each incorporate an independent peripherally surrounded engaging set of frangible finger members 26, neither portion of container 50 can be removed and subsequently replaced without the consumer being immediately aware of the first removal.

Although product containers 50 could be mounted in the retailer store shelves in the conventional stacked manner, as depicted in FIG. 2, FIG. 9 depicts an alternate support and display system which can be employed with this embodiment, or any of the other embodiments detailed above. In this configuration, support brackets 56 are securely mounted to the side wall 57 of the store's display shelves. As shown in FIG. 9, each of the support brackets 56 is secured to wall 57 a desired distance, which depends upon the particular size of container 50, the room required for display, and the additional room needed for ease of removal of package 50 by the consumer.

Although not shown in FIG. 9, the cooperating, oppositely disposed side walls of the display shelf would incorporate a substantially identical bracket 56 for cooperation therewith. Once brackets 56 are mounted in the desired positions, the entire supporting base 21, with the array of product containers 50 secured thereto, is quickly and easily positioned for display and purchase by merely sliding base 21 into secure, retained engagement within brackets 56. In this way, the entire array of packages 50 can be quickly and easily positioned for purchase by the customer, as well as contained in a precisely desired, vertically aligned relationship with any number of other package retaining bases 21.

Although the preferred embodiment of bracket 56 comprises an elongated, open channel in which base 21 can be easily slid into secure, retained engagement, a variety of alternate bracket configurations can also be employed without departing from the scope of this invention.

As discussed above in reference to the other embodiments, this embodiment may also be employed with a serrated zone for separating frangible finger members 26 completely from base 21 after each container 50 is removed. Alternatively, a dual flange construction could be employed, instead of using frangible finger members 26, with each flange incorporating a serrated zone for complete removal of the flange with container 51 when container 50 is removed from supporting base 21. Furthermore, the label display zones, as well as the score lines or separating lines detailed above, would also be incorporated in base 21 for use by the retailer.

It will thus be seen that the objects set forth above, among those made apparent from the preceding description, are efficiently attained, and since certain changes may be made in the above articles without departing from the scope of the invention, it is intended that all matter contained in the above description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A tamper resistant packaging system for supporting retaining a plurality of product-containing packages and for indicating when any of said packages have been previously removed from its present display position while maintaining the package completely intact, said system comprising:

A. a support base, supportingly retaining a plurality of product-containing packages; and B. a plurality of independent removal indication means formed separately and independently of the product-containing packages and cooperating independently with each of said product-containing packages each of said indicating means comprising a. at least one element being in a first package retaining position wherein said removal indicating means securely retains each of the product-containing packages on the support base, and b. said at least one element being moveable to a second package removed position, wherein the product-containing package is released completely intact in its entirety and said indicating means are permanently configured into said second package removed indicating position thereby indicating package removal has occurred; whereby each product-containing package is securely affixed to the supporting base and retained thereon in secure, affixed association therewith, with each product-containing package being easily removable from the secured position completely intact, with said removal process causing said at least one element to be removed into its second configuration, informing consumers that the originally manufactured product has been removed from the securement zone, while the product-containing package remains totally unchanged and unaffected.

2. The tamper resistant packaging system defined in claim 1, wherein said removal indicating means is further defined as comprising a plurality of frangible finger members, each of said frangible members being independent of the product-containing package.

3. The tamper resistant packaging system defined in claim 2, wherein each of said plurality of frangible finger members is further defined as being affixed along one end thereof to said supporting base and, in its formed position, is formed into secure, abutting contacting engagement with said product-containing package at least along its opposed end, whereby removal of the package from its secure retained position on the support base causes fracture, breakage or permanent deformation of said frangible finger members, thereby providing the consumer with immediate notice that the originally retained package had been previously removed.

4. The tamper resistant packaging system defined in claim 3, wherein said frangible finger members are further defined as peripherally surrounding and independently substantially encircling each product-containing package.

5. The tamper resistant packaging system defined in claim 3, wherein said frangible finger members are further defined as being arrayed about the product-containing package in a side by side, directly adjacent, substantially continuous configuration, peripherally surrounding and independently encircling each product-containing package.

6. The tamper resistant packaging system defined in claim 3, wherein each of said frangible finger members is further defined as incorporating a serrated zone formed along said frangible finger member adjacent the supporting base, thereby causing substantially all of said frangible finger members to be broken off of said supporting base during removal of the product-containing package therefrom.

7. The tamper resistant packaging system defined in claim 3, wherein said product containing package comprises a substantially rectangular shape and said frangible finger members are configured in a substantially rectangular shape peripherally surrounding and abuttingly engaging the product containing package.

8. The tamper resistant packaging system defined in claim 3, wherein said package is further defined as comprising a bottle shape, and said frangible finger members are defined as comprising a substantially circular display, peripherally surrounding and abuttingly engaging the neck portion of said bottle.

9. The tamper resistant packaging system defined in claim 3, wherein said product-containing package is further defined as comprising a conventional wide mouthed jar and lid configuration, and said frangible finger members are further defined as comprising a substantially circular display peripherally surrounding and abuttingly engaging said lid.

10. The tamper resistant packaging system defined in claim 9, wherein said removal indicating means is further defined as comprising two juxtaposed, spaced, aligned, substantially circular arrays of frangible finger members, said first circular array peripherally surrounding and abuttingly engaging the lid of said jar-type container, and the second substantially circular array of frangible finger members peripherally surrounding and abuttingly engaging the jar portion thereof, whereby said jar-type container is incapable of being removed from the support base without causing a plurality of said frangible finger members to be permanently deformed, bent, or otherwise broken during the removal process.

11. The tamper resistant packaging system defined in claim 1, wherein said supporting base is further defined as comprising a plurality of score lines extending therealong to allow said support base to be subdivided into various sections, for any particular configuration or display arrangement desired.

12. The tamper resistant packaging system defined in claim 1, wherein said supporting base is further defined as comprising a label display zone formed along the leading edge thereof and containing all of the necessary product information for ease of consumer reference.

13. The tamper resistant packaging system defined in claim 12, wherein said display zone of said support base is further defined as comprising fastening means formed therealong to allow the label display zone to be quickly and easily affixed to the side edge of said support base, or a supporting display shelf, whenever so desired by the retailer.

* * * * *